United States Patent [19]

du Fresne

[11] Patent Number: 4,486,239

[45] Date of Patent: Dec. 4, 1984

[54] VAPOR DEGREASING SYSTEM

[75] Inventor: Eugene R. du Fresne, Sierra Madre, Calif.

[73] Assignee: California Institute of Technology, Pasadena, Calif.

[21] Appl. No.: 487,843

[22] Filed: Apr. 22, 1983

[51] Int. Cl.[3] ..... B08B 5/00

[52] U.S. Cl. ..... 134/11; 134/31; 134/40; 134/105; 202/170

[58] Field of Search ..... 134/11, 31, 40, 105, 134/108; 202/170; 34/73, 75, 78

[56] References Cited

U.S. PATENT DOCUMENTS

| | | | |
|---|---|---|---|
| 2,036,261 | 4/1936 | Dinley | 134/31 X |
| 2,123,439 | 6/1938 | Savage . | |
| 3,106,928 | 10/1963 | Rand | 134/11 X |
| 3,375,177 | 3/1968 | Rand | 34/73 |
| 3,460,990 | 8/1969 | Barday . | |
| 3,904,102 | 9/1975 | Chu et al. | 134/31 X |
| 4,023,983 | 5/1977 | Houke et al. . | |
| 4,032,033 | 6/1977 | Chu et al. . | |
| 4,090,307 | 5/1978 | Gollmick et al. | 34/75 X |
| 4,210,461 | 7/1980 | Moree et al. . | |
| 4,261,111 | 4/1981 | Rand | 34/73 |

*Primary Examiner*—Marc L. Caroff
*Attorney, Agent, or Firm*—Paul R. Wylie

[57] ABSTRACT

A vapor degreasing method and apparatus wherein a second cooling coil is used to prevent escape of solvent or solvent vapor from a degreaser. Gaseous refrigerant from the second coil can be released to the freeboard space above the solvent vapor zone to provide a barrier layer.

9 Claims, 4 Drawing Figures

VAPOR DEGREASING SYSTEM

ORIGIN OF THE INVENTION

The invention described herein was made in the performance of work under a NASA contract and is subject to the provisions of Section 305 of the National Aeronautics and Space Act of 1958, Public Law 85.568 (72 Stat 435; 42 USC 2457).

DESCRIPTION

BACKGROUND OF THE INVENTION

Owing to the high density of the vapor of the chlorinated solvents normally used in solvent vapor degreasers, there is normally relatively little loss quantitatively. Unfortunately, such loss as does occur is a subject of concern: chlorinated solvents are implicated in liver damage, various cancers, smog formation, and upper-atmosphere photochemical reactions tending to remove the ozone layer. If solvent losses could be reduced by an order of magnitude, or if nonchlorinated solvents could be used without creating a fire hazard, a substantial improvement in safety would be achieved. In either case, it is important that the solvent vapors be kept in the degreasing tank and not be permitted to escape to the atmosphere.

SUMMARY

This invention relates to techniques and improvements in solvent vapor degreasing. More specifically, it relates to methods and apparatus wherein improved safety and degreasing efficiency are obtained.

In the method aspect of the invention, improvements in solvent vapor degreasing are obtained by providing a second cooling zone, in addition to the conventional first cooling zone found in most vapor degreasers, said second cooling zone being at a temperature lower than said first cooling zone, to provide a safety zone in the degreaser tank whereby any solvent vapor escaping from said first solvent vapor zone will be condensed and drop down to the solvent bath, or will be maintained at a level defined generally around said second cooling zone.

According to the apparatus features of the invention, a vapor degreasing apparatus is provided that includes an additional freeboard zone above the conventional tank, and a second cooling means located above the conventional first cooling means, to facilitate the introduction and maintenance of a second vapor layer above a first solvent vapor layer.

A feature of the invention is the provision of a method and apparatus whereby the refrigerant in a second cooling means can be released in gaseous form to become a second vapor barrier layer.

It is an object of the invention to provide a method and apparatus whereby vapor degreasing can be carried out in an efficient and safe manner wherein the solvent vapor will not be carried off into the atmosphere surrounding the vapor degreaser.

Another object of this invention is the provision of a method and apparatus whereby a refrigerant used in the cooling means of the vapor degreaser can additionally be used to define a vapor barrier blanket over the solvent vapor of the degreaser.

In attempting to provide a method of safely operating a vapor degreaser, the various objects of the invention were met by providing a method and apparatus whereby a vapor degreaser could be operated efficiently and safely. In achieving this goal it was found that various method and apparatus modifications of conventional degreasers could be effected. These modifications included the improvements of adding a second cooling coil to a conventional vapor degreaser whereby an additional safety zone in the degreaser could be provided to prevent the escape of vaporized solvent. An apparatus was also developed using a secondary cooling coil and additional freeboard space to accommodate a secondary vapor barrier layer in the vapor degreaser.

In a preferred form of the invention the coolant in the secondary cooling coil can be released to the atmosphere above the solvent vapor level to provide the necessary secondary vapor barrier.

THE PRIOR ART

Several U.S. patents have addressed the problem of maintaining solvent vapor in a vapor degreaser and preventing such solvent vapor from escaping to the atmosphere.

U.S. Pat. No. 4,210,461 to Moree et al discloses a single cooling coil vapor degreaser where the solvent may also be used as the cooling medium (Col. 2, lines 60–65).

U.S. Pat. No. 4,032,033 to Chu et al discloses a solvent heat transfer device for soldering, using first and second cooling coils and layered solvent vapors of different vapor density.

U.S. Pat. No. 4,023,983 to Houke et al discloses a vapor degreasing technique utilizing a preferred $CO_2$ vapor barrier layer and acetone as a degreasing solvent. Only a single enclosed coolant coil is used.

U.S. Pat. No. 3,460,990 to Barday discloses a technique utilizing a barrier layer comprising a mixture of solvent vapor and dry air.

U.S. Pat. No. 3,238,065 to Fullhart discloses a vapor degreaser with a single cooling coil and U.S. Pat. No. 2,123,439 to Savage discloses two cooling coils with one being located between liquid and vapor sections of the degreaser.

The foregoing patents to Chu et al and Savage disclose two cooling coils but neither uses them to control and form a barrier layer in a freeboard space. None of the patents discussed above disclosed the use of a barrier layer vapor material as the coolant for a second coil.

BRIEF DESCRIPTION OF THE INVENTION

According to the invention, there is provided a method for solvent vapor degreasing comprising the steps of maintaining a liquid solvent bath; heating the solvent bath at a temperature to provide a solvent vapor zone; providing a first cooling zone above the solvent bath at a temperature such as to condense the solvent vapor at such cooling zone to provide an upper level to said solvent vapor zone, and providing a second cooling zone above the first cooling zone at a temperature lower than said first cooling zone to provide a safety zone or area whereby any solvent vapor escaping from the first solvent vapor zone will be condensed or maintained at a level defined by said second cooling zone.

In the apparatus according to the invention, a tank is provided to contain a liquid solvent bath in the bottom thereof with a solvent vapor zone above it. A first cooling means, which preferably may be a cooling coil, is positioned in the tank in a manner to cool the solvent vapors and thereby define an upper level of the solvent vapor zone. The first cooling means is adapted to be cooled to a temperature sufficiently low to condense the solvent vapor. A second cooling means is mounted above said first cooling means and said second cooling means is adapted to be cooled to a temperature lower than the temperature to which the first cooling means is cooled. A freeboard zone is provided in the tank above the second cooling means whereby a second vapor layer of a gas having a molecular weight lower then the molecular weight of said solvent vapor but higher than the molecular weight of ambient air is maintained as a barrier layer above the solvent vapor.

A feature of the invention is the use of a second cooling coil as the second cooling means with the coil having means to release a refrigerant contained in said coil to the atmosphere in a gaseous state above said vapor layer, whereby said refrigerant gas can form the secondary vapor layer to prevent escape of such solvent vapor layer.

DESCRIPTION OF THE DRAWING

The invention will be more fully understood by referring to the accompanying drawing wherein.

DETAILED DESCRIPTION OF THE INVENTION

Figure 1:
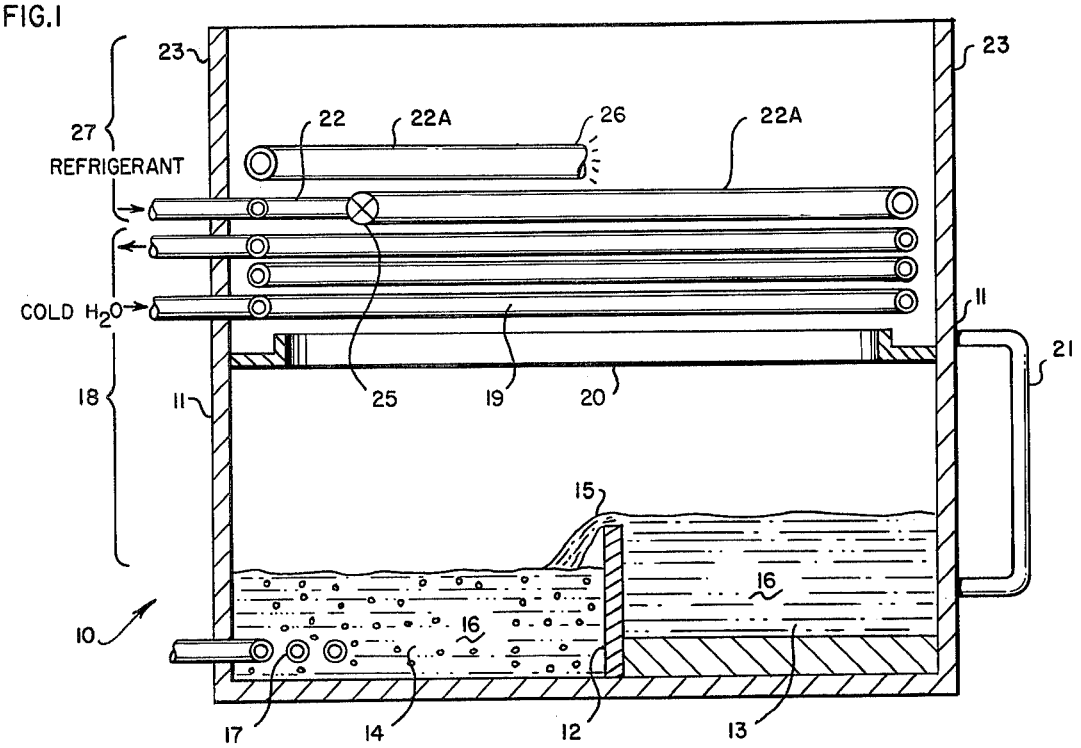
FIG. 1 is a schematic elevation in cross-section of the apparatus according to the invention.

With reference to the drawing generally described above, the following is a detailed description of the invention.

The apparatus includes a solvent vapor degreaser 10 including a tank 11. The tank has a baffle 12 to divide the bottom of the tank into a cold tank portion 13 and hot tank portion 14. The baffle 12 provides a weir 15 over which an excess of fluid in the cold tank portion 13 flows into the hot tank portion 14. The cold tank and the hot tank contain a liquid solvent 16. A heating coil 17 in the bottom of tank 14 provides heat to vaporize solvent 16 and create a solvent vapor zone 18 above the liquid solvent. Water filled cooling coils 19 are provided around the periphery of the tank at a level selected to provide a solvent vapor zone of sufficient depth to carry out solvent degreasing operations in the tank. Water cooling coils 19 are sufficiently cold to cause condensation of the solvent vapor at the level of the cooling coil and produce a solvent vapor blanket above the liquid solvent 16. Vaporized solvent condenses upon coils and runs into solvent return trough 20 back and through return conduit 21 into cold tank 13.

According to the invention, there is provided a second cooling coil 22 and 22A mounted above said first cooling coil 19. Said second cooling coil 22 and 22A like cooling coil 19 runs around the periphery of tank 11. Additional freeboard space 23 is provided on tank 11 above said second cooling coil 22.

Figure 2:
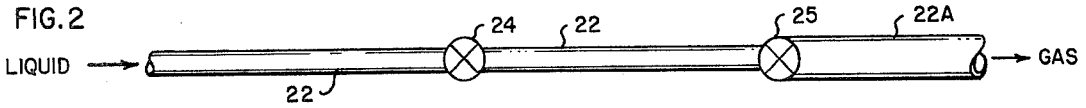
FIG. 2 is a schematic cross-section view of a valve used in the apparatus FIG. 1 of the invention; and, FIGS. 3 and 4 are schematic cross-section views of an alternate refrigerant expander to be used in the apparatus of FIG. 1.

As shown in FIG. 2, in a preferred form of the invention, liquid introduced through on/off valve 24 to cooling coil 22 can be released and expanded through needle valve 25 into coil 22A where it circulates and is then released at outlet 26 to form a second vapor layer in the zone 27 provided by additional freeboard space 23.

Figure 3:
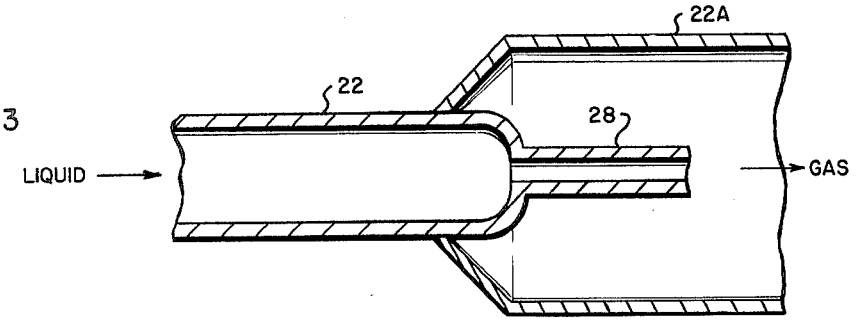
Figure 4:
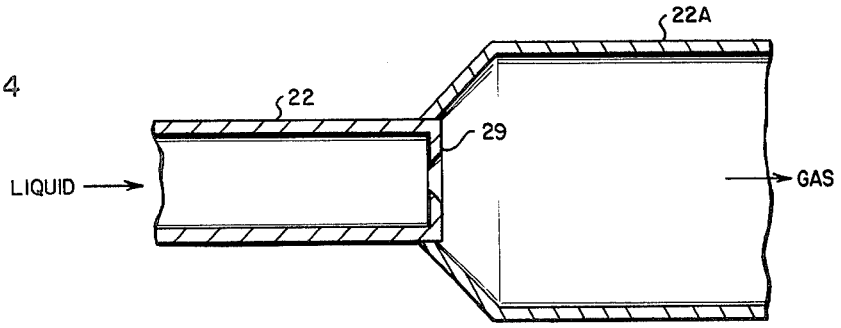

Alternately, the liquid coolant in cooling coil 22, can be released through an orifice type valve as shown in FIG. 3 where the liquid in cooling coil 22 is expanded through hypodermic tubing 28 into downstream coil 22A. Another orifice type valve is shown in FIG. 4 where the liquid is expanded through pierced disk 29.

In operation, the apparatus works as follows: Liquid solvent 16 is maintained in both the cold and hot tanks 13 and 14 respectively. The hot tank 14 is heated by a heating medium in heating coil 17 to a temperature such as to provide a solvent vapor zone 18 above the upper surface of the liquid solvent 16. The first cooling zone is provided above the liquid solvent bath by cooling coil 19 through which a cooling medium such as cold water is circulated. The solvent vapor rising from hot tank 14 condenses on cooling coil 19 to thereby provide an upper level to said solvent vapor zone. A second cooling zone is provided above the first cooling zone by means of cooling coil 22A which carries a refrigerant at a temperature lower than the temperature of the cooling medium in the first cooling coil. Any vaporized solvent escaping from the first solvent vapor zone 18 as defined in its upper limit by cooling coil 19 would then condense on cooling coil 22A, and would further be prevented from escaping from the tank. As previously noted, condensed solvent runs down from both cooling coils 19 and 22, into trough 20 and is returned to cold tank 13 via conduit 21.

In a preferred method according to the invention, a refrigerant is confined in the second cooling coil 22A and subsequently released as gas from said cooling coil to form a second vapor layer over the solvent vapor. The second vapor layer will have a molecular weight lower than the molecular weight of the solvent vapor, but higher than the molecular weight of air, so as to effect a blanket of said second vapor which will not rise from the tank as extended by the freeboard portion 23 into the atmosphere, but instead will continue to be maintained as a barrier layer over the solvent vapor zone 18.

Articles to be degreased are typically placed in a basket (not shown) and lowered into hot tank 14. There, boiling solvent 16, having been heated by the heating medium in coil 17, removes by agitation and solvent power most of the grease, chips, dirt, etc. that are on the articles. The basket is then transferred to cold tank 13 where further dissolution of grease takes place. More importantly, the basket of articles is cooled below the boiling point of the solvent. This step serves not only as a cooling step but also as a rinsing step since the concentration of grease is far less in the cold tank than in the hot tank. A vigorous shake of the basket as it leaves the cold tank 13 removes most of the oil and grease and the cold solvent from the articles. The basket is then hung in the solvent vapor zone 18 where vapor condenses on the cold parts and runs down washing away the remaining soluble contaminants. When the articles reach the boiling temperature of the solvent, this washing action ceases and they are ready to be removed.

When the basket is moved above the solvent vapor zone, it may carry some additional condensed solvent and/or vapor with it which, according to the invention, will be condensed rather quickly by the second cooling coil 22 to assure that no solvent or solvent vapor is carried out of the tank. As the basket of parts ascends, any solvent vapor will be washed out of it by the cooled air around the second cooling coil.

In a preferred method of the invention, the second cooling coil 22 and 22A is provided with a refrigerant which can be released from the cooling coil to form a second vapor layer above the solvent vapor with said second vapor layer having a molecular weight lower than the molecular weight of said solvent vapor, but higher than the molecular weight of air, so that it provides a blanket within the freeboard space 23 of tank 11 to prevent escape of solvent vapor from the tank. The vapor is released from the cooling coil 22A at a temperature above the freezing point of the solvent but below that where the released vapor would expand and rise from the tank before reaching equilibrium temperature conditions with the ambient air. Thus, effectively, a barrier layer in zone 27 is established.

In a preferred embodiment of the invention, expanding $CO_2$ can be utilized as the refrigerant in second cooling coil 22A. Liquid $CO_2$ can be delivered to coil 22 from a siphon cylinder (not shown). Alternatively, a comparable reserve such as a Liquiflow unit containing $CO_2$ at 0° F. and 300 psi can be used. Coil 22A is made of thermally conductive tubing such as copper or aluminum. The $CO_2$ expands in the coil generating intense cold. The $CO_2$ can then be released from the coil through an open end. The $CO_2$ cools the coil by expansion through devices such as those shown in FIG. 2, 3 or 4, which are placed near the upstream end of coil 22 and 22A. The $CO_2$ is not recycled but remains as a barrier blanket in zone 27 provided by the freeboard source 23 of tank 11. Additional $CO_2$ is made up from time to time to replenish any $CO_2$ that is removed from the barrier layer in freeboard space 23 by removal of baskets of articles being vapor degreased.

In general, refrigerants which can be released from coil 22A at a temperature above the freezing point of the solvent, and have a molecular weight above the molecular weight of air but below the molecular weight of the solvent vapor, can be used. Such refrigerants include $CO_2$, $CClF_3$, Argon, $CF_4$, $CCl_2F_2$, $CHClF_2$ and Krypton.

The following is a table of essential thermodynamic values of the refrigerants that can be used according to the invention:

| Refrigerant | Molecular Weight | Normal B. P. | Critical Temperature |
|---|---|---|---|
| $CO_2$ | 44 | sublimes −78.5° C. (boils at −56.6 at 5.2 atm.) | 31.0° C. |
| $CClF_3$ Refrigerant (Freon) 13 | 104.46 | −81.4 | 28.9 |
| $CHF_3$ Refrigerant 23 | 70.01 | −82.03 | 25.9 |
| Ar (Argon) | 40 | −185.7 | −122.3 |
| $CF_4$ | 88 | −128 | −45.67 |
| $CCl_2F_2$ | 120.91 | −29.79 | 122 |
| $CHClF_2$ | 80.47 | −40.75 | 96 |
| Kr (Krypton) | 83.80 | −152.3 | −63.8 |

With the use of a second vapor layer as a barrier layer according to the invention, the vaporized solvent would be displaced from a basket of degreased articles by the vapor of the barrier layer as the basket moves through the barrier layer. Thus, when the basket of articles reaches the air above the barrier layer, the air would then displace the barrier layer vapor and not the vaporized solvent which was previously displaced by the barrier vapor.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description; and all changes which come within the meaning and range of equivalency of the claims are therefore intended to be embraced therein.

I claim:

1. A method of providing a barrier layer to prevent discharge of solvent vapors in a solvent vapor degreasing process or the like comprising:

(a) maintaining a liquid solvent bath in a tank;

(b) heating said liquid solvent bath to a temperature sufficient to provide a solvent vapor zone above the upper surface of said liquid solvent;

(c) cooling a first zone in the tank above said upper surface of said liquid solvent bath to a temperature sufficient to condense said solvent and to define an upper limit to said solvent vapor zone;

(d) cooling a second zone in the tank above said first zone to a temperature lower than the temperature of said first zone to provide a safety zone whereby any solvent vapor escaping from said solvent vapor zone will be condensed or maintained at a level defined by said second zone, said second zone being cooled by a cooling receptacle containing a refrigerant confined therein; and (e) subsequently releasing said refrigerant as a gas into the tank from said cooling receptacle to form a second vapor layer above said solvent vapor zone, said second vapor layer having a molecular weight lower than the molecular weight of said solvent vapor but higher than the molecular weight of air.

2. A method according to claim 1 wherein $CO_2$ is used as the refrigerant for said second zone and wherein said $CO_2$ is maintained in a liquid phase in said cooling receptacle.

3. A method according to claim 1 wherein said second vapor layer is released from said cooling receptacle at a temperature above the freezing point of said solvent but at a temperature where the weight per volume of said second vapor layer will be higher than that of the ambient air above said second vapor layer.

4. A method according to claim 1 wherein water is provided as a cooling medium for the first zone and $CO_2$ is provided as the refrigerant for the second zone.

5. A method according to claim 1 wherein the refrigerant for said second zone is selected from the group consisting of $CO_2$, $CClF_3$, $CHF_3$, Argon, $CF_4$, $CCl_2F_2$, $CHClF_2$ and Krypton.

6. An apparatus for solvent vapor degreasing or the like comprising:

(a) a tank adapted to contain a liquid solvent bath in the bottom thereof and having a solvent vapor zone above said liquid solvent bath;

(b) a first cooling coil positioned in said tank for cooling and condensing said solvent vapors, to define an upper level of said solvent vapor zone;

(c) a second cooling coil positioned in said tank and mounted above said first cooling coil, with means for maintaining said second cooling coil at a temperature lower than the temperature to which said first cooling coil is cooled; said second cooling coil being provided with means to release a refrigerant contained therein into the tank whereby said refrigerant vaporizes to become a second vapor layer; and, (d) a freeboard zone being provided in said tank above said second cooling coil, and the refrigerant having a molecular weight lower than the molecular weight of said solvent vapor, but higher than the molecular weight of ambient air, whereby said second vapor layer is maintained as a barrier layer above said solvent vapor zone.

7. An apparatus according to claim 6 wherein said release means comprise an expansion valve.

8. An apparatus according to claim 7 wherein said expansion valve is a needle valve.

9. An apparatus according to claim 7 wherein said expansion valve is a fixed orifice.

* * * * *